US006233814B1

(12) United States Patent
Bast et al.

(10) Patent No.: US 6,233,814 B1
(45) Date of Patent: May 22, 2001

(54) METHOD OF PRODUCING AN ELECTROMAGNETIC COIL

(75) Inventors: Robert Bast, Barsinghausen; Frank Rieck, Burjelof; Klaus-D. Wustefeld; Werner M. Leuschner, both of Hannover; Horst Grove, Langenhagen; Heinrich Rheinlander, Hannover, all of (DE)

(73) Assignee: Nass Magnet GmbH, Hannover (DE)

( * ) Notice: Subject to any disclaimer, the term of this patent is extended or adjusted under 35 U.S.C. 154(b) by 0 days.

(21) Appl. No.: 09/298,023

(22) Filed: Apr. 22, 1999

Related U.S. Application Data

(62) Division of application No. 08/857,435, filed on May 16, 1997.

(30) Foreign Application Priority Data

Jun. 5, 1996 (DE) ..... 196 22 634

(51) Int. Cl.[7] ..... H01F 7/06
(52) U.S. Cl. ..... 29/605; 29/602.1; 336/192
(58) Field of Search ..... 29/605, 606, 602.1; 336/192, 65, 96, 107

(56) References Cited

U.S. PATENT DOCUMENTS

| | | | | |
|---|---|---|---|---|
| 3,138,771 | * | 6/1964 | Goldsmith et al. | 29/602.1 |
| 3,199,178 | * | 8/1965 | Renskers | 29/602.1 |
| 3,350,670 | * | 10/1967 | Strauch | 29/605 |
| 3,691,656 | * | 9/1972 | Mochizuki et al. | 29/602.1 |
| 3,824,518 | * | 7/1974 | Slenker | 29/602.1 |
| 3,936,931 | * | 2/1976 | Hubbartt | 29/605 |
| 4,354,310 | * | 10/1982 | Hatton | 29/605 |
| 4,774,756 | * | 10/1988 | Dethienne | 29/605 |

FOREIGN PATENT DOCUMENTS

| | | | | |
|---|---|---|---|---|
| 4313608 | | 4/1993 | (DE) . | |
| 61-150313 | * | 7/1986 | (JP) | 29/605 |
| 2-21609 | * | 1/1990 | (JP) | 29/605 |

* cited by examiner

*Primary Examiner*—Lee Young
*Assistant Examiner*—A. Dexter Tugbang
(74) *Attorney, Agent, or Firm*—Reising, Ethington, Barnes, Kissele, Learman & McCulloch, P.C.

(57) ABSTRACT

A method of producing an electromagnetic coil comprises winding a length of electrically conductive wire about a non-conductive tubular body having electrically conductive pins embedded therein, coupling opposite ends of the wire to the respective pins, and embedding the pins more deeply in the body following the coupling of the opposite ends of the wire to such pins.

9 Claims, 4 Drawing Sheets

Figure 1:
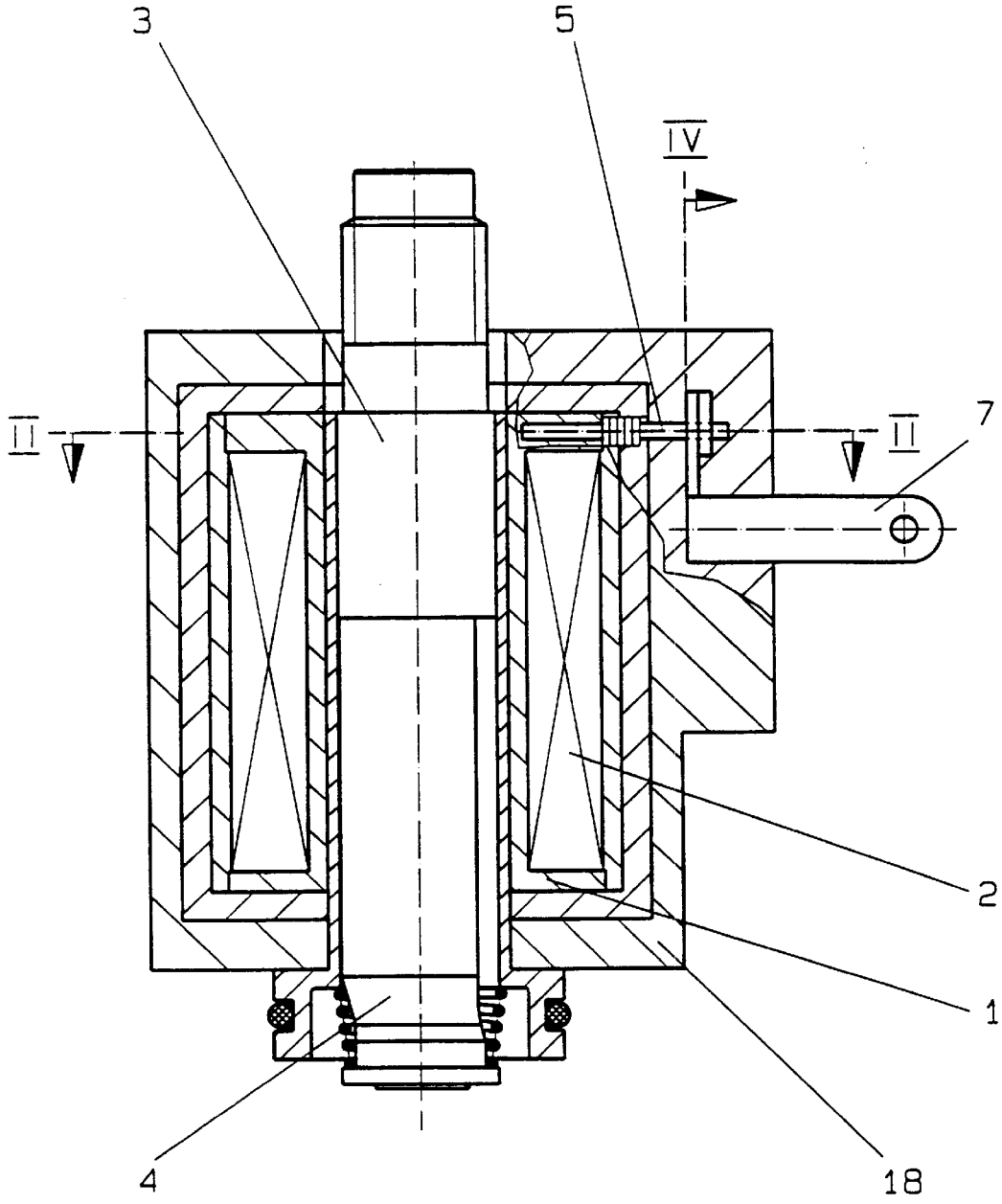

Fig.4
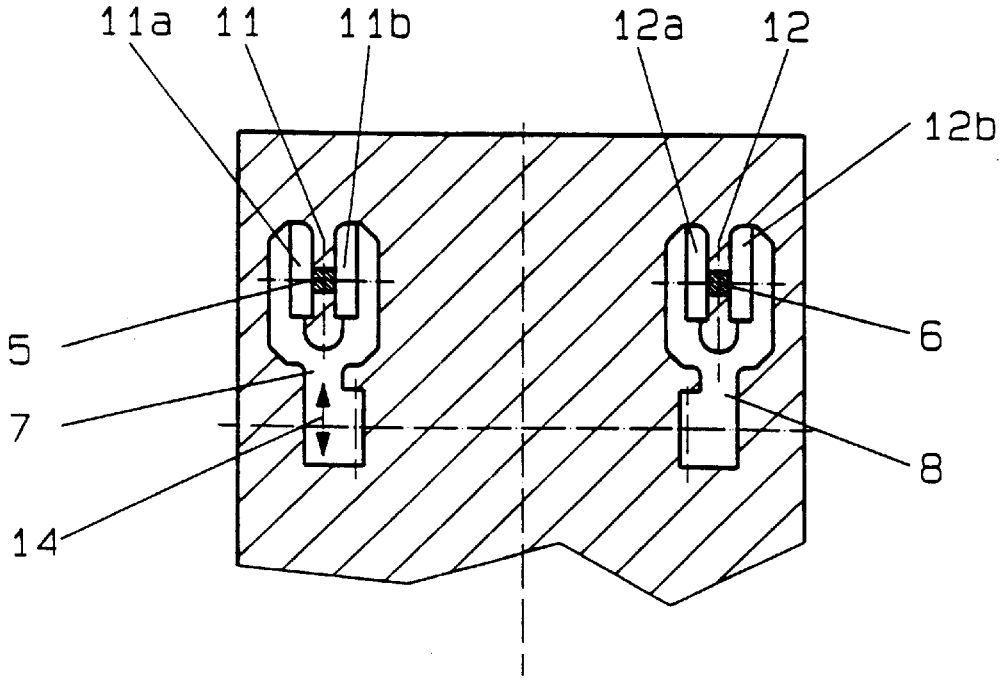
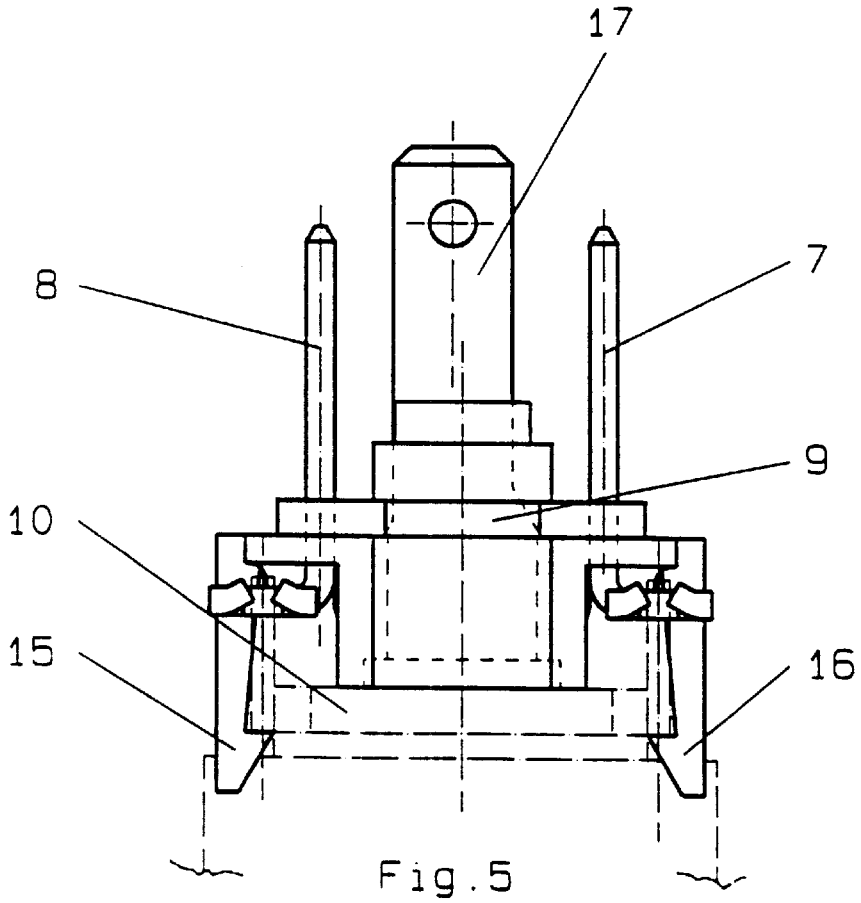
Fig.5

METHOD OF PRODUCING AN ELECTROMAGNETIC COIL

This application is a division of application Ser. No. 08/857,435 filed May 16, 1997.

The invention relates to a magnetic coil and to a method for manufacture thereof.

BACKGROUND OF THE INVENTION

Magnetic coils are known in the art, consisting of a coil body of wound coil wire, the two ends of which are led outwards, two contact pins which are each wound round with one end of the coil wire, two connection tabs which can be coupled to the contact pins and a plastic sheath.

The electrical connection between the contact pins and the coil wire, which is usually insulated with varnish, is made by a suitable supply of mechanical or electrical energy. In DEA-43 13 608 for this purpose the contact pin and the coil wire are excited by coupling in of oscillations in the ultrasound range, contacts being produced by the friction between the coil wire which is kept biased and individual regions of the contact pins touching the wound coil wire. The connection tabs are usually welded to the contact pins. The resulting relatively rigid connection leads in the mass production of such magnetic coils to a relatively high failure rate due to breaking of the coil wire which is usually very thin and in some circumstances is only 0.04 mm thick. This breaking occurs due to the unavoidable relative movements of the connection tabs and the coil body during insertion and processing in the plastic sheath mould.

The object of the invention, therefore, is to improve the magnetic coil and the method for manufacture thereof with a view to a lower failure rate and thereby to simplify the manufacture.

SUMMARY OF THE INVENTION

Since the connection tabs are coupled to the contact pins in such a way that on the one hand an electrical connection is ensured and on the other hand a movability of the connection tab relative to the contact pin is ensured in the longitudinal direction thereof, a relatively flexible connection is produced between the contact pin and the connection tabs. This connection absorbs the unavoidable relative movements of the connections tabs with respect to the coil body without breaking of the coil wire on the contact pin.

In a particularly advantageous embodiment the connection between the connection tab and the contact pin not only permits a relative displacement in the longitudinal direction of the contact pin but also transversely with respect to this direction. This results in an additional degree of freedom which ensures an even more flexible connection between the connection tab and the contact pin or coil body.

According to the invention the coil wire, which is usually coated with an insulating layer of varnish, is contacted with the contact pins by dip soldering. For this purpose the region of the contact pins which is wound round with the coil wire is dipped into a solder bath, the temperature of which is so hot that the insulating varnish decomposes and due to the solder an electrical connection is produced between the contact pin and the coil wire.

THE DRAWINGS

Figure 3:
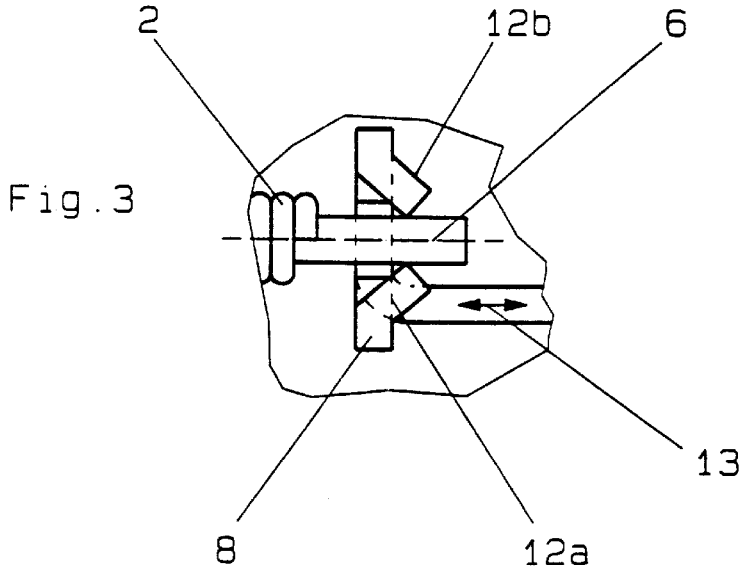
Figure 2:
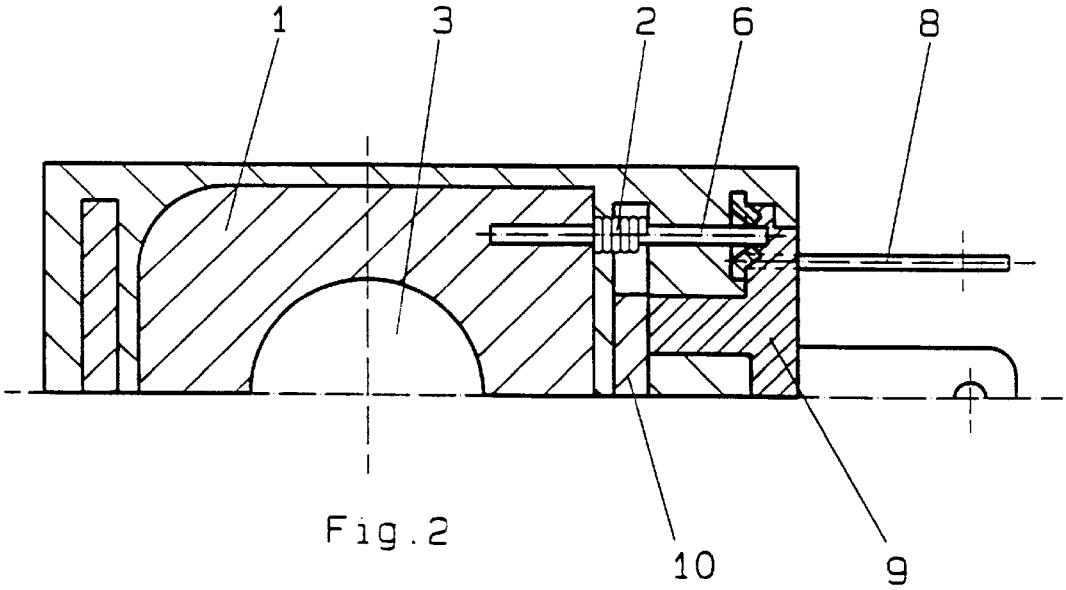
Figure 6:
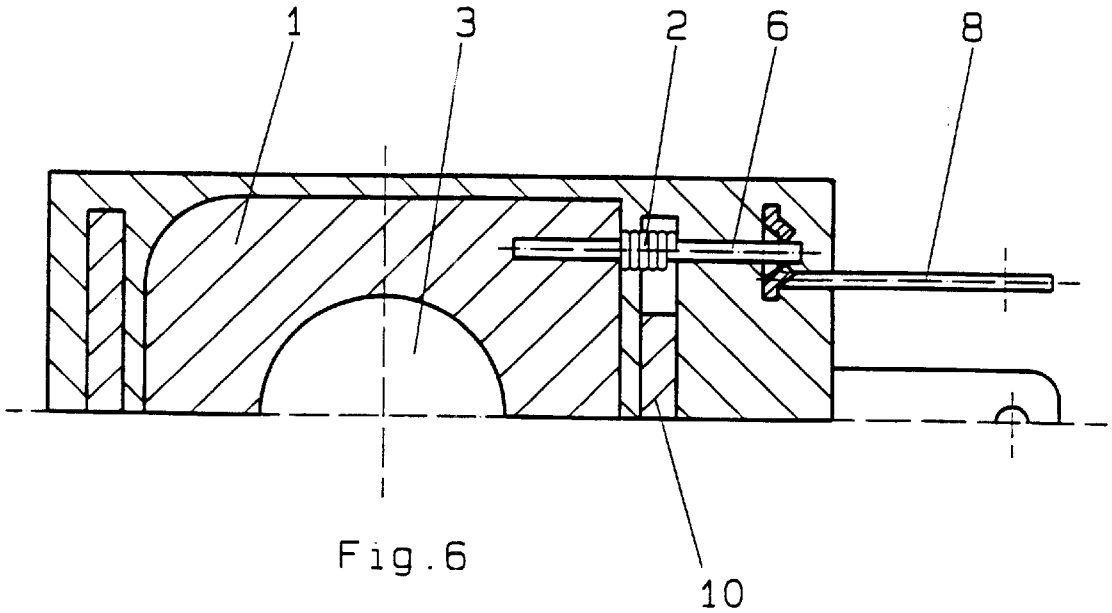

FIG. 1 shows a sectional representation of a magnetic coil according to the invention, FIG. 2 shows a sectional representation along the line II—II in FIG. 1, FIG. 3 shows an enlarged detail view in the region of the contact between a connection tab and a contact pin, FIG. 4 shows a sectional representation on the line IV of FIG. 1, FIG. 5 shows a top view of a connection tab support and FIG. 6 shows a sectional representation of a second embodiment.

DETAILED DESCRIPTION

The magnetic coil shown in FIG. 1 consists essentially of a tubular coil body 1 with wound coil wire 2, a magnetic core 3 and an armature 4.

Two contact pins 5, 6 are also provided, around each of which one end of the coil wire 2 is convolutely wound as shown in FIGS. 1 and 3. These contact pins 5, 6 have one end inserted or embedded in the coil body 1, each of the other ends extending outward and being coupled to a connection tab 7, 8.

The two connection tabs 7, 8 are disposed on a connection tab support 9 which is mounted on a yoke 10 of the magnetic coil.

For coupling to the contact pins 5, 6 the connection tabs 7, 8 have clamping means which on the one hand ensure an electrical connection and on the other hand ensure a movability of the connection tabs relative to the contact pins in the longitudinal direction thereof. In the preferred embodiment which is shown in the drawings these clamping means also permit an additional relative movability of the connection tabs relative to the contact pins transversely with respect to the longitudinal direction of the contact pins.

In the illustrated embodiment these clamping means are constructed as slots 11, 12 in the connection tabs 7, 8, the contact pins 5, 6 being retained between the flanks 11*a*, 11*b* or 12*a*, 12*b* respectively delimiting the slots 11, 12. The two flanks 11*a*, 11*b* or 12*a* , 12*b* respectively are bent up somewhat, i.e., out of the plane of the tabs, the resulting slot opening being somewhat smaller than the width of the contact pins which are preferably square in cross-section. In this case the two flanks of a slot have sharp edges and a spring effect, so that when it is pushed onto a contact pin a secure, frictional electrical connection is ensured by engagement of the sharp edges of the flanks with the wire. Also, after pushing on, a movability of the connection tabs in the longitudinal direction of the contact pins is possible (double arrow 13).

As can be seen particularly from FIG. 4, this type of coupling also facilitates a relative movability transversely with respect to the longitudinal direction of the contact pins, as is indicated by the double arrow 14. In this case the contact pins are displaced in the direction of the slot 11, 12.

The two connection tabs 7, 8 are disposed on the connection support 9 shown in FIG. 5, this connection support 9 having two snap hooks 15, 16 which can be coupled to the magnet yoke 10. In this case an electrical contact is produced simultaneously between an earth connection tab 17 and the magnet yoke 10. Whilst the individual connection tabs are made from electrically conductive material, particularly metal, the connection support 9 is produced from nonconductive material, preferably plastic.

In FIG. 6 a second embodiment according to the invention is shown, which differs from the previously described variant only in that the connection tabs 7, 8 are not disposed on a connection support.

The individual method steps in the manufacture of the magnetic coils according to the invention are explained in greater detail below:

In a first method step the two ends of the coil wire 2 are each wound by automated means onto one of the two contact pins 5, 6. Then in order to relieve the load on the wound coil wire the contact pins are pressed deeper into the coil body 1.

Since the coil wire is usually coated with an insulating layer of varnish, there is still no electrical connection between the coil wire and the contact pin at this stage in the manufacture. This connection is produced by dipping the end of the contact pin which has the coil wire wound on it into a solder bath which has a temperature of more than 350° C., preferably more than 450° C. At this temperature the insulating layer of the coil wire 2 is decomposed and the solder produces an electrical connection between the coil wire and the contact pin.

In a next operation the connection tabs 7, 8 are pushed onto the contact pins 5, 6. In the embodiment described in FIGS. 1 to 5 the connection tabs are held on the connection support, so that the operation of pushing on takes place simultaneously for both connection tabs. Retention of the connection support is ensured by way of the snap hooks 15, 16.

In a final operation the magnetic coil, including the contact pins and tabs, is enclosed in a plastic sheath 18 by means of a suitable mould, with a portion of the tabs protruding beyond the sheath as is shown in FIGS. 1, 2, and 6

The special type of coupling of the contact pins 5, 6 and the connection tabs 7, 8 produces a relatively flexible connection. As a result the unavoidable relative movements between the connections tabs and the coil can take place without a relative movement between the contact pin and the coil. These unavoidable relative movements take place in particular in the last method step, namely in the plastic sheath 18. Thus the extremely thin coil wire, which in some circumstances has a diameter of only 0.04 mm, is protected much more reliably against breaking in this stage of the process.

Furthermore, the type of connection of the coil wire 2 and contact pins 5, 6 on the one hand and the clamping means of the connection tabs on the other hand constitute means which substantially simplify the manufacturing operation per se. Thus in particular a welding operation can be dispensed with in the contacting of the connection tabs. Thus the magnetic coils according to the invention can be manufactured not only at a lower cost but also with a lower reject rate.

Such magnetic coils are used for example in connection with solenoid valve coils with which valves of fluid conduits can be controlled.

What is claimed is:

1. A method of producing an electromagnetic coil comprising:

a. winding a length of electrically conductive wire about a tubular body having spaced, electrically conductive pins embedded therein and projecting outward of said body;

b. coupling opposite ends of said length of wire to respective ones of said pins externally of said body;

C. and embedding said pins more deeply in said body following coupling said opposite ends of said length of wire to said pins.

2. The method according to claim 1 including coupling said ends of said length of wire to the respective pins by winding the ends of said wire about the respective pins.

3. The method according to claim 1 including coupling the ends of said length of wire to the respective pins by soldering the ends of said wire to the respective pins.

4. The method according to claim 1 wherein the opposite ends of said length of wire bear thermally decomposable insulation and including coupling the ends of said length of wire to said pins by soldering at a temperature at which the insulation decomposes.

5. The method according to claim 4 including winding the opposite ends of said length of wire about the respective pins prior to the soldering step.

6. The method according to claim 5 wherein the soldering step comprises dipping the opposite ends of said length of wire in molten solder having a temperature sufficiently high to decompose the insulation on said ends of said wire.

7. The method according to claim 1 including sheathing said coil, said body, said ends of said wire, and a portion of the contact pins in non-conductive plastic material.

8. A method of producing an electromagnetic coil comprising:

a. winding a length of electrically conductive wire bearing thermally decomposable insulation about a tubular body having spaced, electrically conductive pins embedded therein and projecting outward of said body;

b. winding opposite ends of said length of wire about respective ones of said pins externally of said body;

c. embedding said pins more deeply in said body following the winding of said opposite ends of said length of wire about said respective ones of said pins, thereby relieving the ends of said wire of tensile stress; and d. securing said opposite ends of said wire to said pins by dipping said pins and those portions of the opposite ends of said wire wound about said pins in solder having a temperature sufficiently high to decompose the insulation at said opposite ends of said wire.

9. The method according to claim 8 including sheathing said coil, said body, said ends of said wire, and a portion of the contact pins in a non-conductive plastic material.

* * * * *